US005133847A

United States Patent [19]

Boyd

[11] Patent Number: 5,133,847

[45] Date of Patent: Jul. 28, 1992

[54] COMPONENT CARRIER, METHOD OF MANUFACTURE AND USE THEREFOR

[75] Inventor: David M. Boyd, Palmyra, Pa.

[73] Assignee: AMP Incorporated, Harrisburg, Pa.

[21] Appl. No.: 662,310

[22] Filed: Feb. 28, 1991

[51] Int. Cl.[5] ..... C25D 17/00

[52] U.S. Cl. ..... 204/198; 204/224 R

[58] Field of Search ..... 204/198, 224 R

[56] References Cited

U.S. PATENT DOCUMENTS

| | | | |
|---|---|---|---|
| 3,657,097 | 4/1972 | Baldock et al. | 204/202 |
| 3,951,772 | 4/1976 | Bick et al. | 204/198 |
| 4,032,414 | 6/1977 | Helder et al. | 204/15 |
| 4,070,265 | 1/1978 | Danneels et al. | 204/206 |
| 4,278,520 | 7/1981 | Turner | 204/207 |
| 4,279,730 | 7/1981 | Noz | 204/206 |
| 4,321,124 | 3/1982 | Audelo | 204/202 |
| 4,401,522 | 8/1983 | Buschow et al. | 204/15 |
| 4,508,611 | 4/1985 | Johnson et al. | 204/202 |
| 4,534,843 | 8/1985 | Johnson et al. | 204/202 |
| 4,539,090 | 9/1985 | Francis | 204/198 |
| 4,545,884 | 10/1985 | Francis | 204/202 |
| 4,904,363 | 2/1990 | Comp | 204/202 |

*Primary Examiner*—T. M. Tufariello

[57] ABSTRACT

A component carrier (20) and method of manufacture and use includes stamping and forming of a metallic sheet metal strip with adjacent component holders (24, 36) each being formed by beams (26, 38) defined by slots (30–34) arranged to grip components (12) for handling and transport; the beams being offset each from the other to allow deflection in the plane of the said beams; and with several embodiments including slots arranged to produce a controlled deflection and receive components of differing cross-sectional areas. The invention method embraces forming the slots by a tool (S.P.) of V-shaped cross-section following the punching of a round hole in the metal strip. Extending the slots (30–34) into the strip base (22) facilitates loading of the carrier by controlling beam spreading.

9 Claims, 4 Drawing Sheets

COMPONENT CARRIER, METHOD OF MANUFACTURE AND USE THEREFOR

This invention relates to a component carrier or bandolier for transporting components such as electrical contact pins for the purposes of manufacture, plating, assembly, and the like.

BACKGROUND OF THE INVENTION

Component carriers, or bandoliers, which are used to transport components such as electrical contacts, pins, and the like, for a variety of manufacturing purposes, are well known. U.S. Pat. No. 4,904,363 teaches the use of a carrier in conjunction with a selective electro-plating apparatus. The carrier which in this patent is called a conveyor belt, is taught as being comprised of a flexible, electrically conductive material, such as cartridge brass, which is used to make electrical contact with electrical contact pins, so that they may be plated. The carrier includes a base having holes therein adapted to be driven by sprocket teeth and a series of fingers extending from the base, the fingers being so shaped as to resiliently receive contact pins and hold the pins during plating operations. The patent further teaches the possibility of plating the ends of the component gripped by the carrier in different plating baths to provide selectively different platings for the pin.

The '363 patent and certain of the prior art patents cited therein, teach a wide variety of carrier or bandolier constructions. One of the problems associated with the use of carriers relates to the current trend of the electronics industry toward miniaturization of parts and an associated desire to place such parts on as close centerlines as possible, thereby providing more parts per inch and more parts per unit of time that can be handled, plated and assembled, thus increasing efficiency in manufacturing and assembling. Additionally, by placing the parts on the center-to-center spacings of components into which they will be loaded or, at least, upon center-to-center spacings which are a multiple thereof; handling steps, which are costly and which may result in contact damage, can be substantially reduced. For example, if a component board such as a circuit board is to be loaded with pins, or a connector housing is similarly to be loaded with pins, having the pins presented on the center-to-center spacing of such board or such housing, simplifies the need to place the pins on such centers for multiple loading.

A second problem facing the use of carriers is one of minimizing damage to the component part caused by the carrier and engagement therewith. This may happen during loading of the part into or unloading of the part from the carrier, particularly with respect to those carriers that are made of metal and have sharp edges, which can scratch or gouge the parts or the platings thereof.

Still a further problem is specifically related to how to manufacture very small carriers that are required to carry components on close spacings, how to manufacture the miniaturized features of a carrier, particularly a carrier made of sheet metal, how to use it in loading and unloading, and how to adapt it to a practical manufacturing tool.

The foregoing problems are addressed by the improvement carrier strip of the present invention.

It is an object of the present invention to provide a carrier having a configuration that facilitates the handling of small components on close centers in a manner which minimizes component damage.

It is another object to provide a carrier having a configuration that facilitates the handling of small components without the need for secondary means for clinching, locking or retaining the components in the carrier.

It is a further object of the present invention to provide a method of manufacture for such carrier in a number of embodiments as well as a method of utilizing such carrier to advantage.

SUMMARY OF THE INVENTION

The present invention achieves the foregoing objects by providing a carrier stamped and formed out of thin, resilient, sheet metal stock, the carrier including a central base portion having at either end thereof upstanding holder portions slotted to define spring beams having interior surfaces to receive and retain components such as pins. The holder slots further include a beveled portion and, in one embodiment, a rounded portion and a slot extending therefrom into the base portion so that upon loading of a component into the slot, the beam spreads resiliently and elastically open to develop a retaining force against the component in the two positions of the spaced-apart beams. The invention includes having adjacent holders formed to be offset to provide a clearance therebetween, thereby allowing outward deflection without interference. In manufacture, the foregoing configuration is achieved by shearing the sheet metal between adjacent holders, avoiding the need for removal of material and fine punches and further helping to facilitate close centers with respect to the carrier. The carrier slot is given in several embodiments different interior configurations to generally match the cross-sectional configuration of the component at the locations thereon where it is gripped by the carrier.

Additionally, an apparatus is taught, including reels and a spindle for arcuately deforming the carrier in one embodiment to open the slot and beams to receive a component and then to close such beams to resiliently grip such component for further transport and use.

A method is taught wherein the slots formed in the carrier holders defining the beams thereof are achieved by first punching a hole and then punching a notch which, if required, can extend through the area of the hole to reduce the need for fine punches subject to breakage and limited wear life. Still another aspect of the invention relates to its use as a splice to join the ends of similar loaded carrier assemblies. The splice uses segments of an unloaded carrier strip to grip the components proximate the ends of the components, at the ends of both of the loaded carriers thereby holding the butted strips in alignment with one another.

IN THE DRAWING

DETAILED DESCRIPTION OF THE INVENTION

Figure 1:
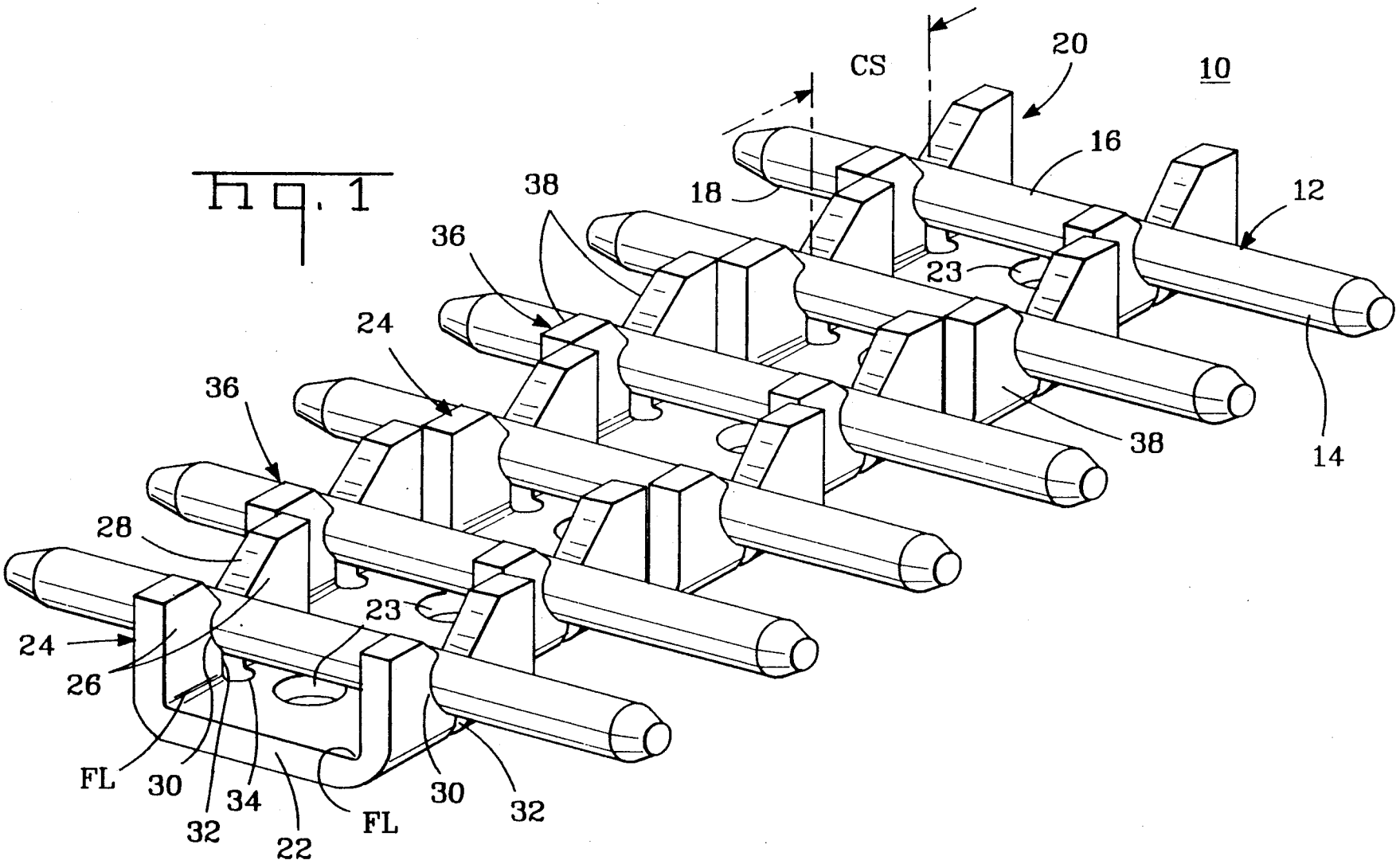
FIG. 1 is a perspective view showing a carrier loaded with components in accordance with one embodiment of the invention, enlarged many fold from its actual size.

Referring now to FIG. 1, the carrier 20 of the invention in the first preferred embodiment is shown in relation to an assembly 10 which includes carrier 20 carrying a series of components 12 in the form of electrical contact pins. Carriers such as 20 are frequently termed bandoliers and the view in FIG. 1 is of but a segment of such carrier, it being understood that frequently carriers are hundreds of feet in length, when utilized with reels or, in certain instances, cut into sticks on the order of inches or more in length. Important to the description of the invention is an understanding that the carrier shown in FIG. 1 is designed to accommodate components 12 such as round or rectangular contact pins or terminals, which are relatively small, being on the order of between 0.010 inches to 0.030 inches in diameter or along a side and ranging from lengths of several hundred thousandths inches to over an inch in length. With respect to the view in FIG. 1, the components or pins 12 thereshown were, in one example, 0.018 inches in diameter, and the carrier 20 was rendered to accommodate pins 12 on center-to-center spacings of 0.050 inches, the center spacing denominated C.S. being defined as the distance between the center lines of adjacent pins as shown in FIG. 1. The pins 12 each include tapered ends 14 and 18 and a body 16, the pins having a round configuration in this particular embodiment; it being understood that pins of various cross-sections are contemplated. Such pins are used for a variety of interconnection purposes and frequently are manufactured as by screw machining wire stock or stamping, forming, or impact forming wire form or sheet metal stock to the desired configuration with subsequent plating of one or both ends of the pins and subsequent loading into insulating housings, boards, for a variety of electrical uses.

Figure 2:
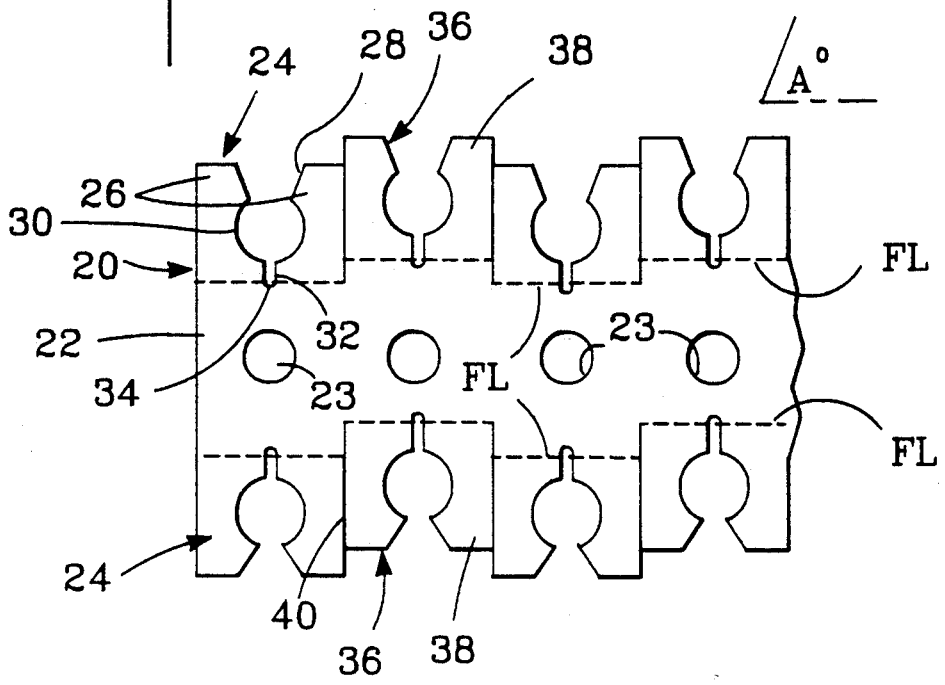
FIG. 2 is a plan view of the carrier of FIG. 1, following blanking but prior to forming.

With respect to the embodiment shown in FIG. 1, the carrier 20 includes a thin, resilient base 22 and a plurality of first and second component holding portions 24,36 arranged in an alternating and staggered array along the carrier 20. First and second carrier portions 24,36 are defined by opposed and spaced apart pairs of beam portions 26,38 respectively, extending upwardly from and essentially perpendicular to opposed longitudinal edges of base 22. The respective pairs of beam portions 26 include a tapered or funnel entry portion 28 extending from an end edge of each beam portion 26, each respective pair of beam portions defining a slot structure therebetween which includes a rounded surface 30 and a slot 32 ending at end portion 34 which in the embodiment of FIG. 1 extends into the base 22. The configuration of the second component holder beam portions 38 is identical to that of first holder beam portions 26. The respective beam portions 26,38 are configured, thereby, to receive a component and hold the component transversely to base 22. First and second component holding portions 24,36 are formed by bending the respective beam portions upward from base 22. As shown in FIGS. 1 and 2, base 22 includes an array of staggered fold lines F.L. on each side of the base such that adjacent holding portions 24,36 are offset from each other by at least the thickness of the carrier material plus enough spacing so that the respective beam portions 26,38 of holders 24 and 36 can be flexed or deflected outwardly in the plane of the beam portions 26 thereof to receive component 12 in the slot structure therebetween without interference from the beam portions 38 of adjacent second component holders 36. The offset arrangement of adjacent holding portions 24,36 further permits use of tooling, where necessary, to assist in closing respective pairs of beams 26,38 over ends of the components mounted therebetween. So, too, the adjacent remaining holders are offset with respect to adjacent carriers to accommodate a resilient deformation or deflection of each of the holder beams 26,38 upon loading and, in certain instances, upon unloading with respect to the embodiment shown in FIG. 1.

Figure 3:
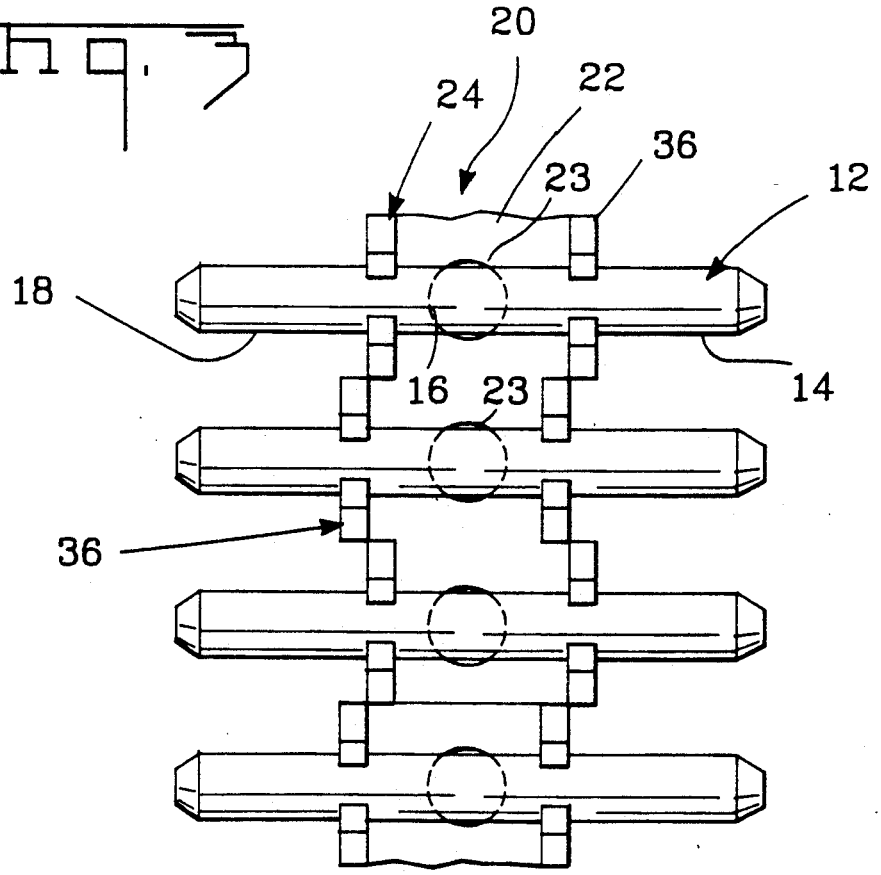
FIG. 3 is a plan view of the carrier of FIGS. 1 and 2 following forming and loading of components therein.

FIG. 2 shows the blanked form of the carrier 20 further includes a sheared edge 40 extending between each holder 24 and 38 and transverse to the length of the carrier 20. FIGS. 1 and 2 further show a plurality of pilot holds 23 extending along the base 22, apertures 23 providing means to align metal strips as it is stamped or blanked and bent to form the carrier 20 and also as an alignment means for loading and unloading carrier 20. To be noted that in the embodiment of FIGS. 1 and 2, the slot portion 32, including the end of the slot 34 extends through the fold line into the base 22. It is to be understood that the exact shape and length of the slot portion 32 depends upon the configuration of the component to be held by the respective component holders 24,36 as well as the relative stiffness of the material used to make carrier 20. Note also the angle A, shown in FIG. 2, with respect to the funnel or beveled entry defined by surfaces 28. This angle helps to guide a component being inserted into the slot structure of the carrier 20. The angle may be varied between 15 degrees and 30 degrees, depending upon application and use and the configuration of the component 12 in cross-section at the point of insertion into the carrier 20. FIG. 3 shows the carrier 20 after forming and loaded with components 12 and viewed from the top to illustrate the offset provided by the array of staggered adjacent first and second holders 24,36.

Figure 4:
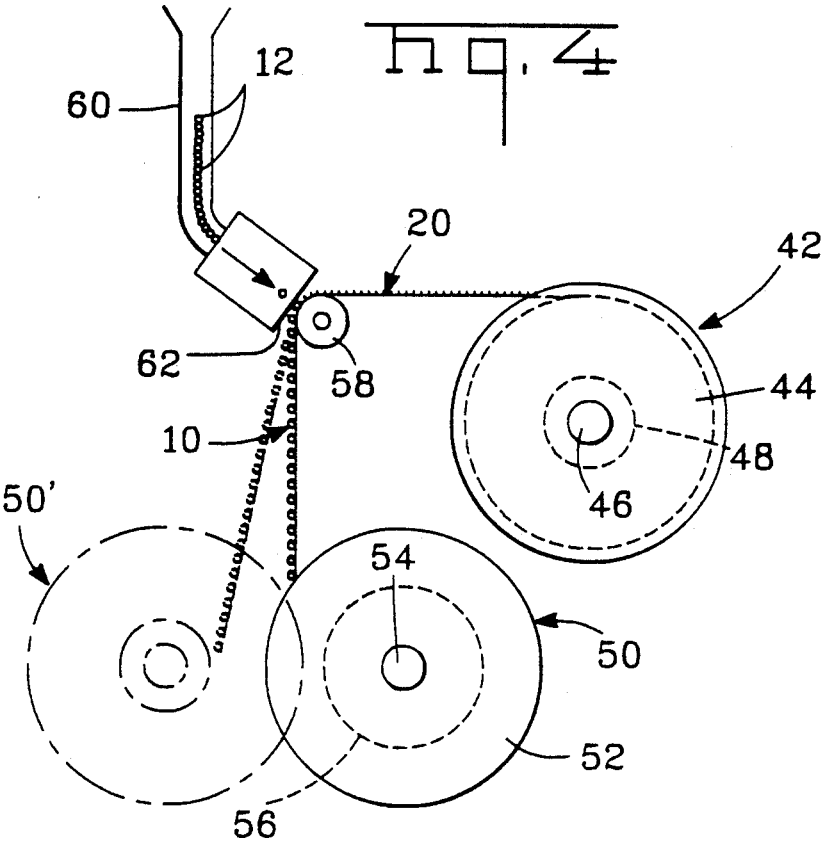
FIG. 4 is a schematic and elevational view of a reel and spindle transport apparatus utilizing the invention.

FIG. 4 shows a representative assembly for loading carrier 20, with components 12 to form the carrier assembly 10. A supply reel 42 of a construction typically used for reeling terminals and the like includes circular side wall portions 44 spaced apart generally by the width of the carrier 20, if the carrier is wrap loaded or spaced apart by many multiples of such width if the carrier is spirally loaded, with both sides 44 bonded to a spindle or shaft 46 having an inner core 48 around which the carrier 20 is wrapped. The reel 42 is preferably allowed to rotate freely under the pull of carrier 20 by spindle 58 at loading station 60, spindle 50 having means as known in the art for engaging pilot holes 23 to align and pull the carrier through the loading station. The carrier assembly 10 is then wound onto a take-up reel 50, itself having side walls 52, a spindle or shaft 54, and a core 56. FIG. 4 illustrates an alternative take-up reel 50' which winds assemblies 10 such that the components "face" the inner core thereby increasing the retention force of the beams against their respective components. In accordance with the invention, the take-up reel 50 is driven preferably by a mechanism, not shown, to rotate periodically, as known in the art, to maintain desired tension in the system. In accordance with one aspect of the invention, the core 56 is given a particular diameter, considerably larger than the diameter of core 48, in order to assure that the respective beam portions 26,38 of the carrier 20 are not deflected open to an extent reducing the holding force on the component pins 12 sufficient to allow their release or dislodgement in either a radial sense or an axial sense relative to the carrier 20. In other words, viewing FIG. 1, it is to be understood that the slot configuration 30, including having the end of the slot 34 extending into the base 22, note also the plan view in FIG. 2, means that as the carrier assembly 10 is caused to curve as by wrapping around the core 56, the arms of beam portions 26,38 will move slightly apart. The base 22 will bend or deform elastically and perhaps inelastically crossways of the carrier owing to the slots 30 extending into such base. As the carrier assembly 10 is straightened out, the pairs of respective beam portions 26,38 of the first and second component holder portions 24,36 will move back together, gripping the component pin 12 even more tightly and deforming elastically to a degree in accordance with the dimensions of the cross-section of the pin 12 in engagement with the respective holder portions 24,36 and the dimensions of the rounded portions 30 of the slot structure. In FIG. 4, the carrier 20 in an unloaded condition is forced around spindle 58 having a very much reduced diameter, which opens the respective beam portions 26,38 to an extent to allow the insertion of the components 12 with either a light frictional fit or at least a much reduced insertion force into the corresponding holder portions 24,36. Alternatively, spindle 58 may be dimensioned to receive the carrier without causing the beams to open and components 12 can be "snapped into" place. A supply of component pins 12 is shown at 60 with means not delineated but understood to be capable of picking and displacing the pins 12 and inserting them into the carrier holder portions 24,36 at 62. The timing of such insertion is controlled by means, not shown, to be synchronized with the displacement of the carrier 20 as driven by means, not shown, but preferably a stepping motor driver attached to the shaft 58; there being appropriate guide rollers and guides, also not shown, for the carrier 20 as unloaded and for the assembly 10 as loaded.

Figure 5:
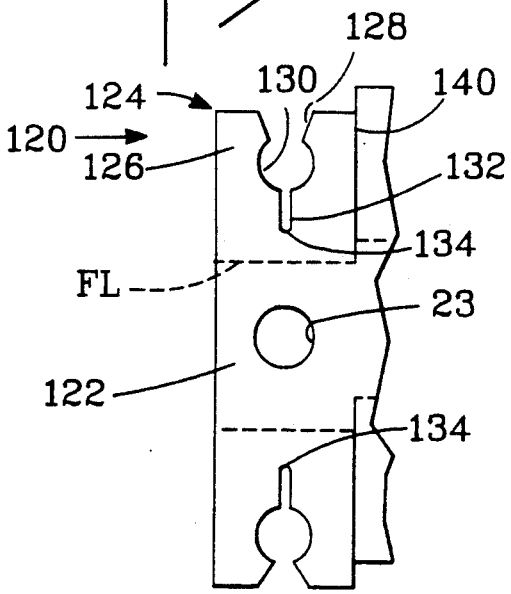
FIG. 5 is a plan view of a carrier in an alternative embodiment of the invention following stamping but prior to forming.

The embodiment of the invention shown in FIG. 1 is specifically designed in accordance with the invention to have a deflection when loaded with the component pin 12, sufficient to allow a reeling upon the smallest diameter of reel 50, namely, the diameter of the core 56 without disgorging the component pins 12 either radially or axially. The invention contemplates a separation of the components 12 from the carrier 20 subsequent to processing for example, plating or the like. To facilitate handling, the curvature of the carrier 20 and in particular, the base 22, is never allowed to be less than that which retains the component pins 12 in the carrier 20. The invention contemplates an unloading of the components by dislodging the components in a predetermined grouping by applying force in a selected direction or by holding the components in a fixture removing the strip 20. A procedure essentially reversed from that shown in FIG. 4 may also be used; namely, feeding the ensemble 10 around a tightly radiused spindle causing the beams to open with the component or pin 12 being then removed by an appropriate mechanism with a minimum amount of loading damage to the pin surfaces engaged by the carrier 20, both during loading and unloading, due to the geometry and arrangement of the carrier 20 and the opening and closing of the respective pairs of beam portions 26,38 thereof. The diameters of the core 56 and spindle 58 may be given a ratio of 10 or 20 to 1, depending upon the amount of deflecting or spreading desired. Referring now to FIG. 5, an alternative carrier construction 120 is shown wherein the fold line F.L., which establishes the width of the base 22, is arranged so as to not intersect the bottom 134 of the slot structure. This may be achieved by appropriate dimensioning of the carrier 120, including the slot depth and base width. Also incorporated into the embodiment of FIG. 5 is an extension of the slit 140 effected by shearing past the fold line F.L., meaning that the minimum width of base 122 occurs along such transverse axis. This in turn means that, upon a bending of the U-shaped form of the embodiment of FIG. 5 as by reeling, the beam portions 126 will be relatively unaffected, contrary to the earlier embodiment wherein the slot extended into the base. In other words, the bend will occur at the shortest or weakest portion of base 22 which occurs along the line of the shear edge 40. The embodiment of FIG. 5 may be preferred in handling components of much smaller cross-sectional dimension than that heretofore described with respect to the embodiment of FIG. 1, noting that in FIG. 5, the rounded portion 130 of slot 132 is reduced. With smaller cross-sections, punch and die tolerances become more critical, especially with respect to the lower or inner portions of the slot leading to the ends 134. The carrier, in accordance with FIG. 5, would rely upon the elastic spring action of the beam portions 126 being deformed to accommodate the insertion or extraction of the pin components 12.

Figure 6:
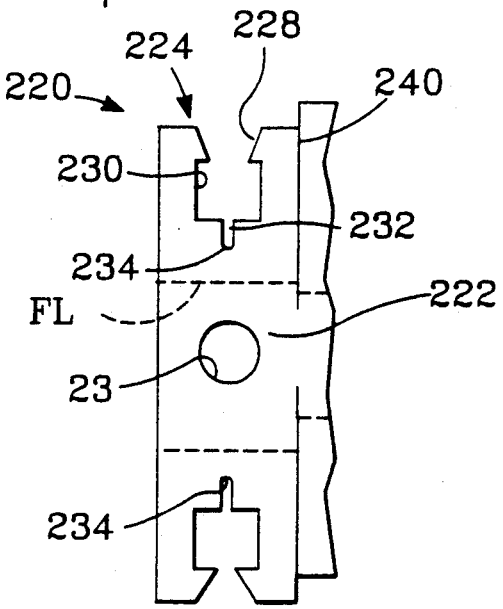
FIG. 6 is yet a further embodiment of the invention carrier in plan, following blanking but prior to forming.

FIG. 6 shows an alternative embodiment 220 wherein the features of the invention are as disclosed with respect to the embodiment of FIG. 5, excepting in the surfaces of slot 230 of holder portion 224 are more rectangular to accommodate rectangular cross-sectioned components, pins, posts, and/or terminals of other end configurations. It is also to be understood that the embodiment of FIG. 6 can be rendered with the slot 232 and slot end portion 234 either extending into the base 22 or, as shown in FIG. 6, not so extending.

Figure 7:
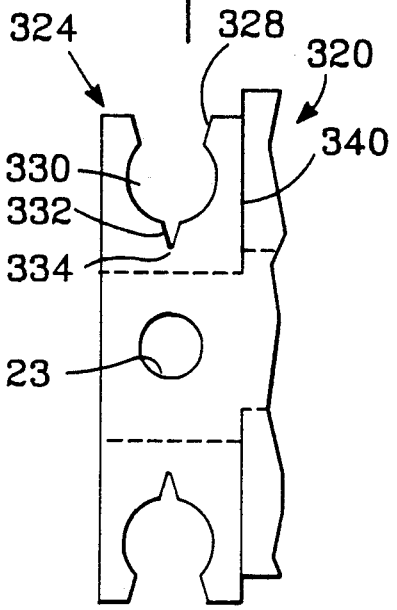
FIG. 7 is a further embodiment of the carrier of the invention in plan, following blanking but prior to forming.

FIG. 7 shows still a further embodiment 320 of the carrier of the invention with hole 330 having slot 332 formed differently to include a tapered end 334 which extends into slot 332 to define the spring beam function of the device.

Figure 8:
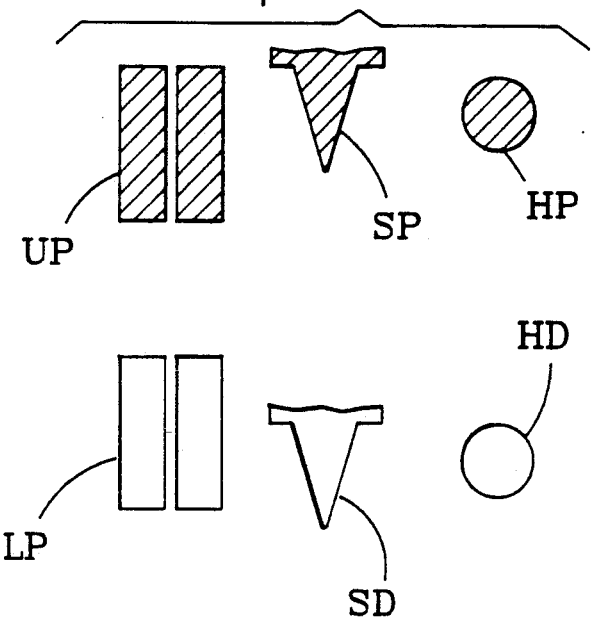
FIG. 8 is a plan view showing in section the configurations of punches and dies utilized to provide the slot of the carrier shown in FIG. 7.
Figure 9:
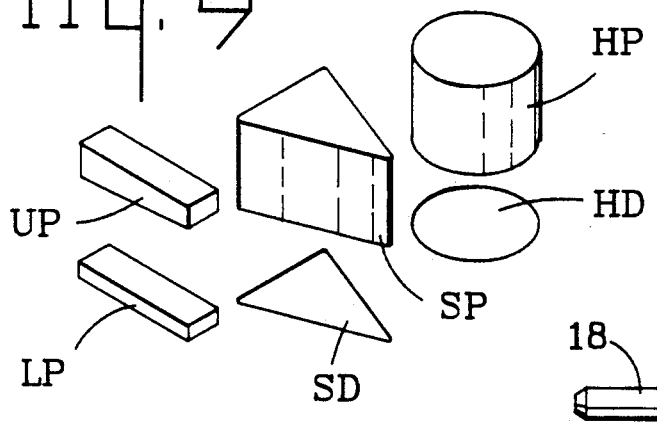
FIG. 9 is a perspective view showing schematically the punches utilized to achieve the slot configuration of the carrier of FIG. 7.

A constant problem in manufacturing of slotted beam structures has to do with the width of the slots relative to the thickness of the material employed and particularly when such slots must be stamped and formed in dimensions wherein the punch and die minimum dimensions approach the thickness of the stock being worked. Very thin punches and dies are difficult to manufacture, wear excessively, break more frequently, and are thus more costly to use. FIGS. 8 and 9 show schematically punches and dies used with respect to the embodiment of FIG. 7 to form the slots in the carrier stock material. For purposes of illustration, the punch and die to form pilot hole 23 are not shown. In accordance with this aspect of the invention, punch and die shapes which form part of a progressive tool are operated to close and open against stock sequentially to punch, pierce, and/or shear are schematically shown in FIG. 8, half of the tooling being shown in FIG. 9. The supporting structure and the punch press driving the tooling shown in these figures is not included, nor is the surrounding and supporting die and punch frame. Also the punch and die for shearing the edges of adjacent holders is not included. Reviewing FIG. 8 and considering that the sheet metal stock to form the carrier of FIG. 7 is fed from right to left, the first hit of the die will punch the pilot holes 23 and notch the edges of the stock to produce the offset carrier array as shown in FIG. 1. For purposes of illustration the punches and dies for producing these shapes have been omitted from FIGS. 8 and 9. The next hit of the tooling will result in the curved or rounded portions of the hole 330 being formed in the stock in the form of a hole having the configuration of the rounded punch labeled H.P. in FIGS. 8 and 9, the die for such station being labeled H.D. in FIG. 9. The stock is then fed again from right to left, the next increment wherein the V-shaped slot punch S.P. and the die S.D. remove additional material from the stock to form the slot 332 extending to end 334 having the plan configuration shown in FIG. 7. As can be discerned, the tooling presented in FIG. 8 is far stronger than the tooling would be to form the narrower slot configurations heretofore shown including particularly the portions 32 and 34 of FIGS. 1 and 2. Alternatively a number of these steps may be performed simultaneously. The robustness of the punches contributes significantly to the tool wear and life. Also shown in FIGS. 8 and 9 are the punch and die shearing elements, including U.P. for the upper punch and L.P. for the lower punch which effect the shearing forming the shear 340 in between adjacent holder structures as shown in FIG. 7.

Figure 10:
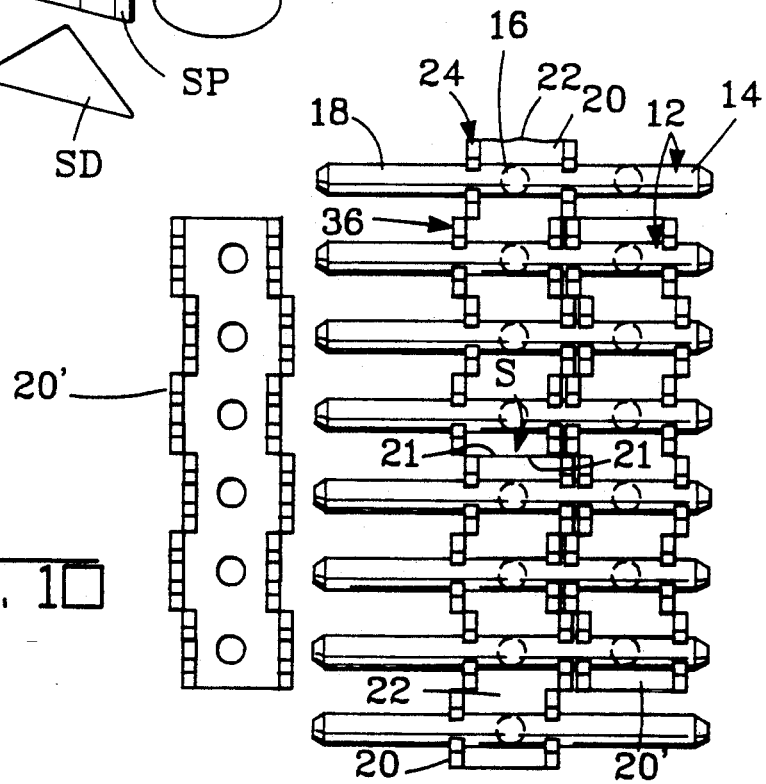
FIG. 10 is a plan view of a use of the invention carrier as a splice.

FIG. 10 shows a use of the invention carrier as a splice. There the end 21 of carrier 20 from a first reel of assemblies is shown to spliced at S to the end 21 of carrier 20 of a second reel of assemblies by use of two carrier segments 20', each including about a plurality of holder units 24,38. Carrier segments 20' are positioned such that one of the segments 20' carries the first end 14 of a plurality of pins 12 in each of the respective carrier strips 20 to be spliced. For purposes of illustration, one carrier strip 20' is shown exploded from the spliced portion. This strip 20' is intended to engage a plurality of second component portions 18 in each of the strips 20 to be spliced. In FIG. 10, strips 20' engage three pins from each of the respective strips. By using strips 20' on both sides of the center strip, the components 12 are kept in alignment and on pitch. The carrier of the invention can thus be used to splice itself for reeling lengths of carrier to achieve a desired length or supply of pin components 12 and may be used whenever the components are of a sufficient size and configured to be retained in such a manner.

The invention contemplates a variety of shapes for the slots as well as a variety of thicknesses for the carrier and the advantages thereof are applicable to a variety of applications wherein the slots are extended into the base past the fold lines of the stock or, in the alternative embodiments shown.

Having now disclosed the invention in the several embodiments and aspects thereof preferred, the claims attached are intended to define what is inventive.

I claim:

1. A carrier for use in transporting components for handling, plating, assembly and the like, on close center-to-center spacings comprising a thin, flexible metal strip stamped and formed to define a series of holders in side-by-side relationship, each holder having a U-shaped cross-sectional geometry to define a pair of spaced-apart beams extending from a base with each beam slotted to define a resilient beam area readily deflected by the insertion of a component in said slots of the pair of holders transverse to the length of said strip, each of said holders being offset relative to the adjacent holder in a plane parallel to the length axis of the strip to facilitate deflection of the holder beams outwardly without interference therebetween whereby upon inserting said components into slots of said beams of said holders of said components are gripped by said beams.

2. The carrier of claim 1 wherein the said slots extend into the base of the U-shaped cross-section whereby upon said strip being reeled around a curved surface of a given radius, said beams will be driven to open apart to receive a component inserted therein and upon said strip being held to a bend curvature of substantially larger radius, said beams will be driven to close to hold said components therein.

3. The carrier of claim 1 wherein said slots in said beams reside within said beams whereby upon said base being reeled around a curved surface of a given radius, said beams will maintain the geometry holding said component in said holder.

4. The carrier of claim 1 wherein said slots include a beveled funnel entry leading to rounded edges of the general configuration of the cross-section of a component to be fitted therein.

5. The carrier of claim 1 wherein said slots include a beveled entry funnel portion leading to parallel sides to receive components having generally rectangular cross-sectional areas at the point of engagement with said holders.

6. The carrier of claim 1 wherein said slot includes a funnel entry leading to surfaces having geometries complementary to said component.

7. The carrier of claim 1 wherein said slot is defined by first edge entry beveled to guide the insertion of a component therein with said entry leading to a further portion of said slot extending to approximately the base of said strip.

8. The carrier of claim 1 wherein said holders are defined each from the other by being sheared without the removal of metal therebetween.

9. The carrier of claim 1 wherein said slot is defined by first punch shape generally of the geometry of the cross-sectional geometry of the component and thereafter by a punch having a cross-section defining a funnel entry and extending through the area removed by said first punch to define a slot providing spring beam characteristics.

* * * * *